US007461526B2

(12) United States Patent
Cesio Caccialli

(10) Patent No.: US 7,461,526 B2
(45) Date of Patent: Dec. 9, 2008

(54) SPIRAL SYSTEM REACTOR FOR THE TREATMENT OF HIDES AND SKINS

(76) Inventor: Luis Cesio Caccialli, 8 de Octubre 4528, CP 12, 100, Montevideo (UY)

( * ) Notice: Subject to any disclaimer, the term of this patent is extended or adjusted under 35 U.S.C. 154(b) by 339 days.

(21) Appl. No.: 10/855,475

(22) Filed: May 27, 2004

(65) Prior Publication Data

US 2005/0034245 A1 Feb. 17, 2005

(30) Foreign Application Priority Data

Aug. 11, 2003 (UY) ..... 27.934

(51) Int. Cl.
*C14C 1/00* (2006.01)

(52) U.S. Cl. ..... 69/30; 69/31; 69/32

(58) Field of Classification Search ..... 69/28–32; 8/94.1 R, 94.14, 94.15, 94.2, 94.21, 94.22
See application file for complete search history.

(56) References Cited

U.S. PATENT DOCUMENTS 78,815 A * 6/1868 Muller ..... 8/94.22
1,893,706 A * 1/1933 Kannel ..... 69/30
3,426,557 A * 2/1969 Pillard ..... 69/30
3,457,742 A * 7/1969 Eckhart et al. ..... 69/30
3,841,909 A * 10/1974 Nonaka et al. ..... 134/5
4,122,692 A * 10/1978 Dose ..... 69/30
4,424,690 A * 1/1984 Gili Bas ..... 69/30
4,441,342 A * 4/1984 Dose et al. ..... 69/30
6,151,932 A * 11/2000 Molto et al. ..... 69/30
6,935,144 B2 * 8/2005 Lakshmanan et al. ..... 69/30
2004/0182118 A1 * 9/2004 Lakshmanan et al. ..... 69/30

* cited by examiner

*Primary Examiner*—Shaun R Hurley

(57) ABSTRACT

A device used for the process of tanning hides and skins is disclosed. The device comprises a cylindrical body including crosspieces of appropriate shape and in appropriate arrangement inside it. The particular features of shape and operation of said device result in an increased load of hides and skins in each operation cycle, a decrease in the requirements of chemicals applied in proportion to the load being processed, a considerable decrease in processing time, and lower water requirements.

10 Claims, 12 Drawing Sheets

SPIRAL SYSTEM REACTOR FOR THE TREATMENT OF HIDES AND SKINS

CROSS REFERENCE TO RELATED APPLICATION

This application claims priority to Uruguayan Patent Application No. 27,934, filed Aug. 11, 2003.

STATEMENT OF FEDERALLY SPONSORED RESEARCH OR DEVELOPMENT

Not applicable.

BACKGROUND OF THE INVENTION

The technical innovation for which we claim authorship and patentability, refers to a device for the tanning process of hides and/or skins. The particular features of the shape and operation of said device result in an increased load of hides and skins in each operation cycle, a decrease in requirements of chemicals applied in proportion to the load being processed, a considerable decrease in processing time, and lower water requirements.

The device of this invention, to be used in steeping, hair scraping, pickling, tanning, retanning, currying (greasing), dyeing, dressing, and beating processes on hides and skins, may operate at variable speeds (from 0.5-0.8 up to 18-20 rpm) according to the various stages in the process for any intended purpose.

Moreover, the efficient mechanical working of the device produces an excellent mixing of solid and liquid elements, thus optimizing homogenization results.

SUMMARY OF THE INVENTION

In one embodiment, a spiral system reactor for treatment of hides and skins is disclosed. The reactor includes a cylindrically shaped body defining a diameter and a longitudinal axis. The body rotates about the longitudinal axis and encloses physically nonintersecting crosspieces of diametrical length that are spaced along at least one axis and intersect that axis at different angles to provide a plurality of mechanical members for scraping, tanning, retanning, dressing, or beating activities on hides and skins as the body is rotated.

In another embodiment, a spiral system reactor for treatment of hides and skins comprises a cylindrically shaped body that is rotatable about a longitudinal axis. The body includes a pair of end walls connected by an interior surface defining an interior of the body. A plurality of physically nonintersecting crosspieces are within the interior of the body, each physically nonintersecting crosspiece includes opposing ends having a base. The bases of the plurality of physically nonintersecting crosspieces are affixed to the interior surface or the end walls, and the plurality of physically nonintersecting crosspieces are spaced apart from the interior surface and the end walls.

These and still other advantages of the present invention will be apparent from the detailed description and drawings. What follows are merely preferred example embodiments of the present invention. To assess the full scope of the invention the claims should be looked to.

DETAILED DESCRIPTION OF THE PREFERRED EXAMPLE EMBODIMENTS

Figure 1A:
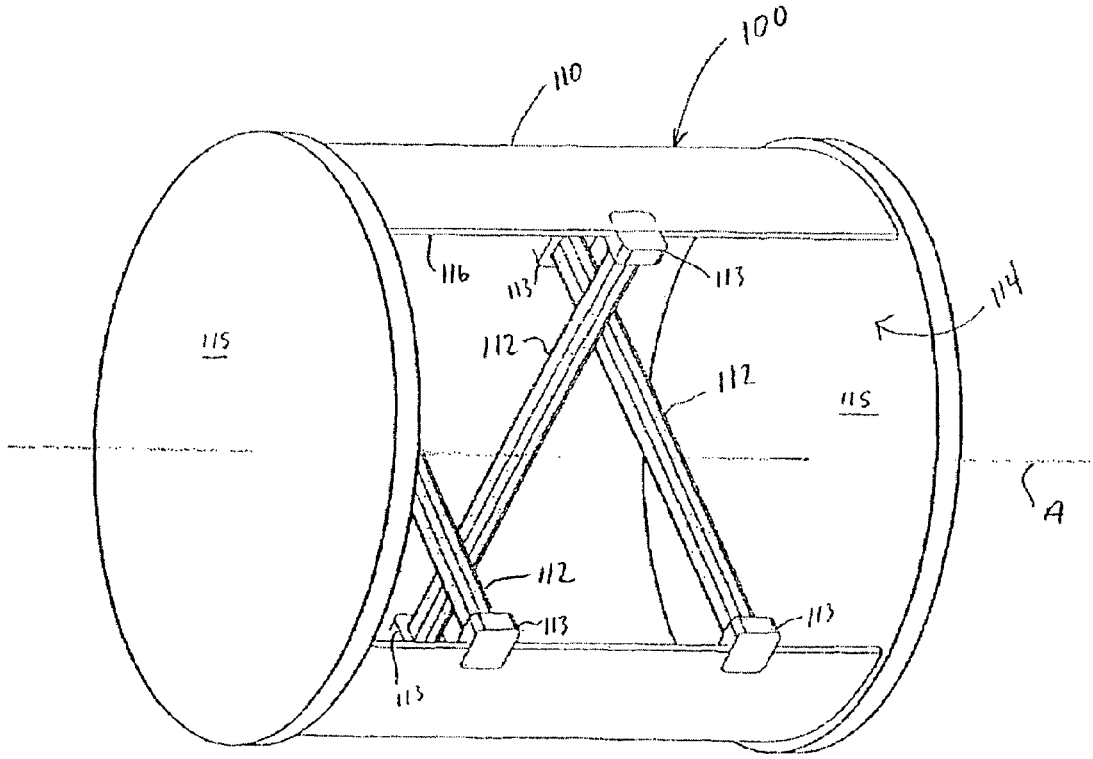
FIG. 1*a* is a partial isometric view showing a first example embodiment of the present invention having a portion of the body removed.
Figure 1B:
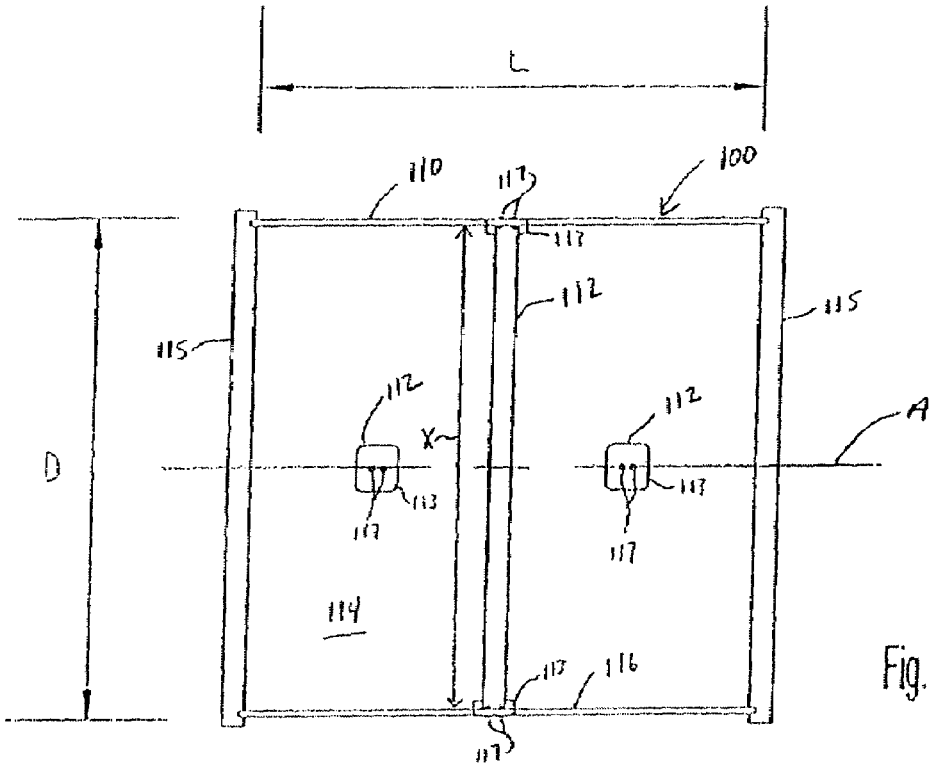
FIG. 1*b* is a partial side view of the first example embodiment shown in FIG. 1*a;*
Figure 1C:
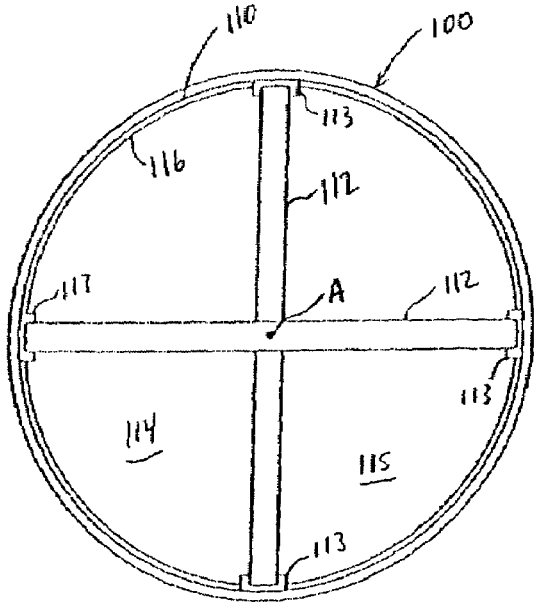
FIG. 1*c* is a partial end view of the first example embodiment shown in FIG. 1*a;*

As shown in FIGS. 1*a*-1*c* of the drawings attached for merely illustrative and not limitative purposes, the reactor device 100 of the present invention consists in a cylindrical vat 110 made of wood, stainless steel, plastic or any other material that will resist the weight of its contents and also any chemicals introduced. The size of said cylindrical vat 110 varying from 1 meter to 5 meters in diameter D (sometimes even greater diameters) and varying also from approximately 1 meter to 5 meters in length L. As shown in FIG. 1*a,* the vat 110 defines an interior 114 having an interior surface 116 connecting a pair of end walls 115.

The reactor 100 is supported along its longitudinal axis A and revolves on its axis A at a speed of from 0.3 to 20 rpm, in both directions. Inside the reactor 100 there is an arrangement of crosspieces 112 of a length X equivalent to the diameter D of the cylinder 110, so as to generate mechanical action in operation. The crosspieces 112 include bases 113 at each end that are affixed to the interior surface 116 via fasteners 117 (shown in FIG. 1*b*) and the like. Each crosspiece 112 is within the interior 114 and extends to engage the interior surface 116 at two locations. In the first example embodiment, the crosspieces 112 extend essentially perpendicular to the longitudinal axis A and through the longitudinal axis A, crossing at approximately ninety degrees to each other as shown in FIG. 1*c.*

Figure 2A:
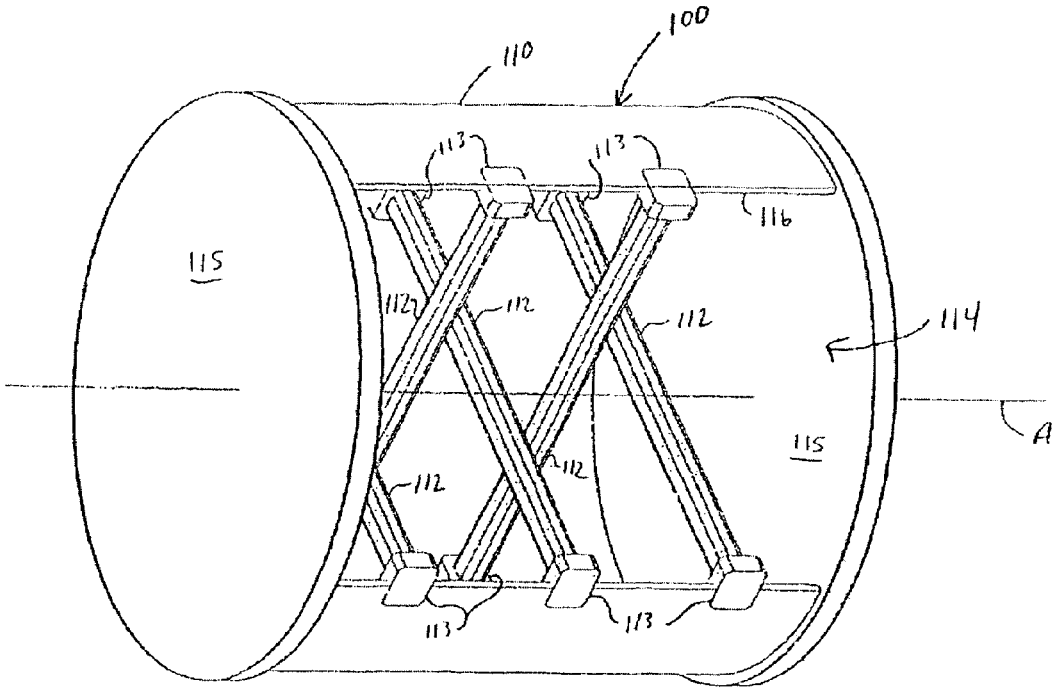
FIG. 2*a* is a partial isometric view showing a second example embodiment of the present invention having a portion of the body removed.
Figure 2B:
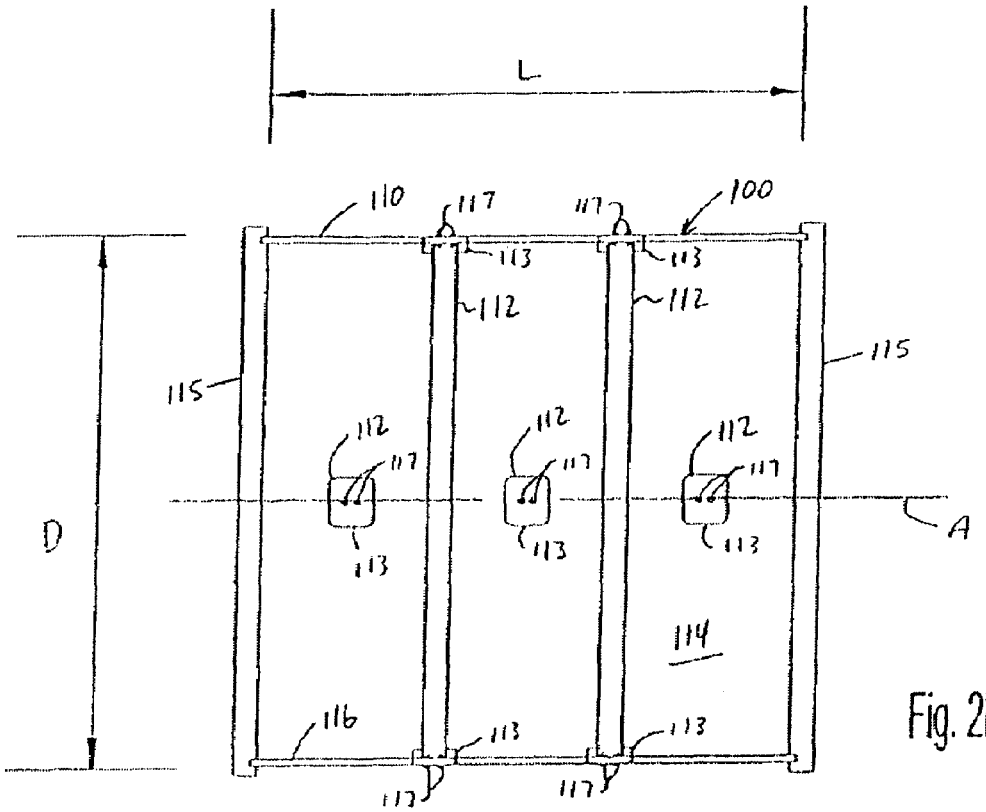
FIG. 2*b* is a partial side view of the second example embodiment shown in FIG. 2*a;*
Figure 2C:
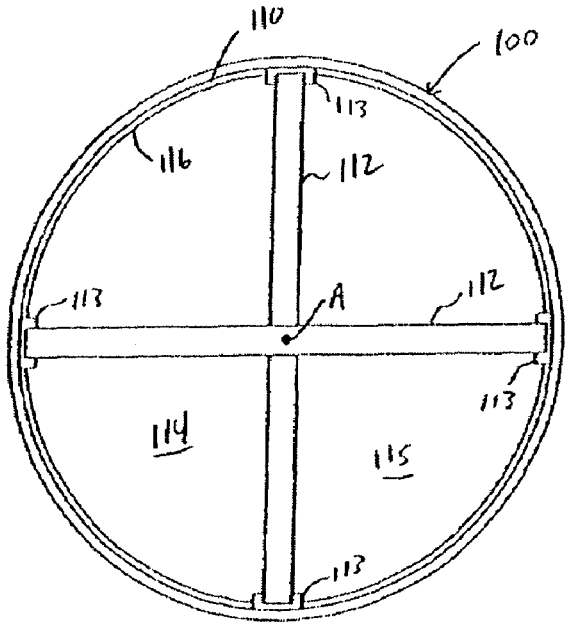
FIG. 2*c* is a partial end view of the second example embodiment shown in FIG. 2*a;*
Figure 3A:
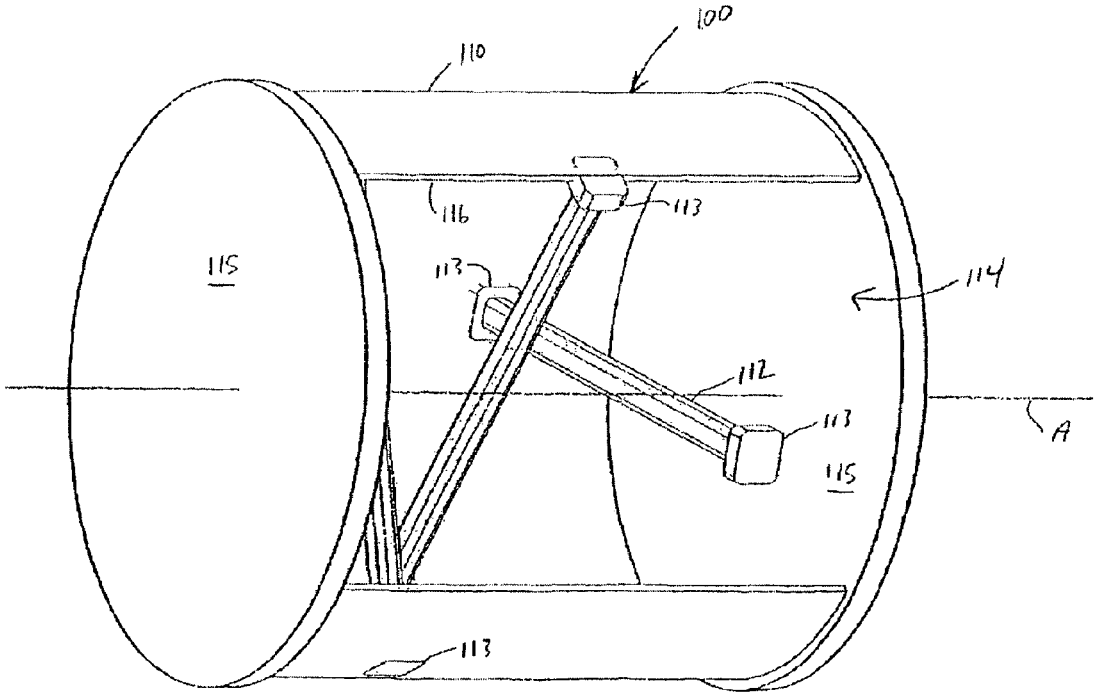
FIG. 3*a* is a partial isometric view showing a third example embodiment of the present invention having a portion of the body removed.
Figure 3B:
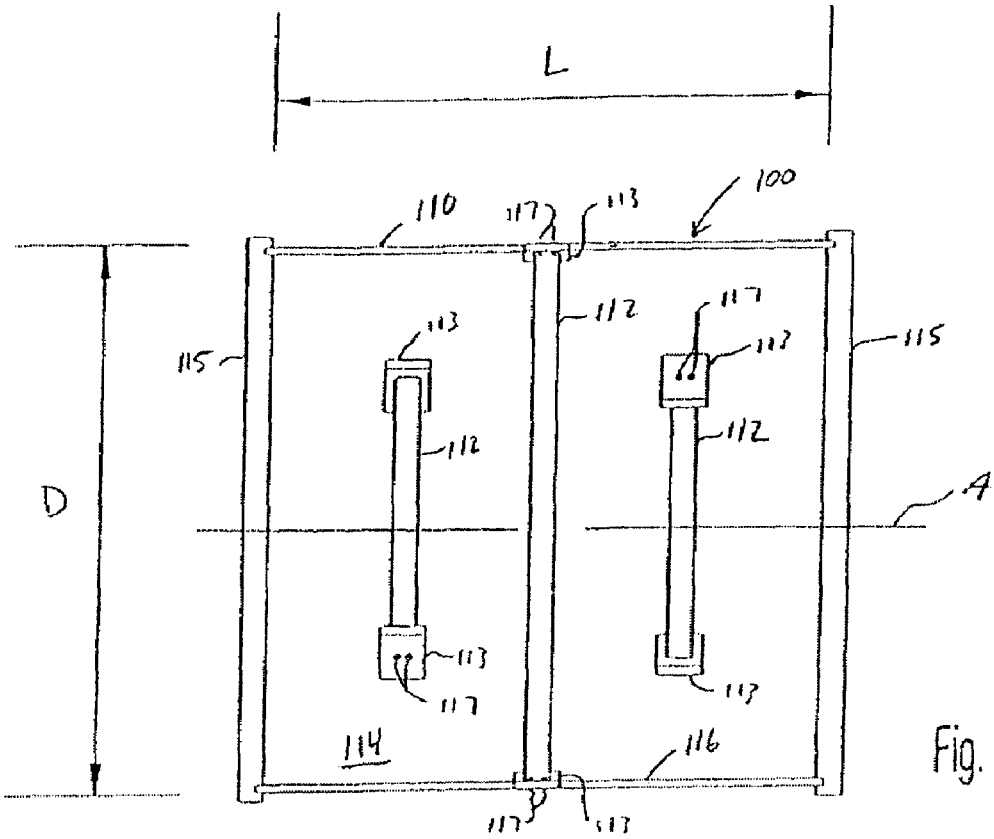
FIG. 3*b* is a partial side view of the third example embodiment shown in FIG. 3*a;*
Figure 3C:
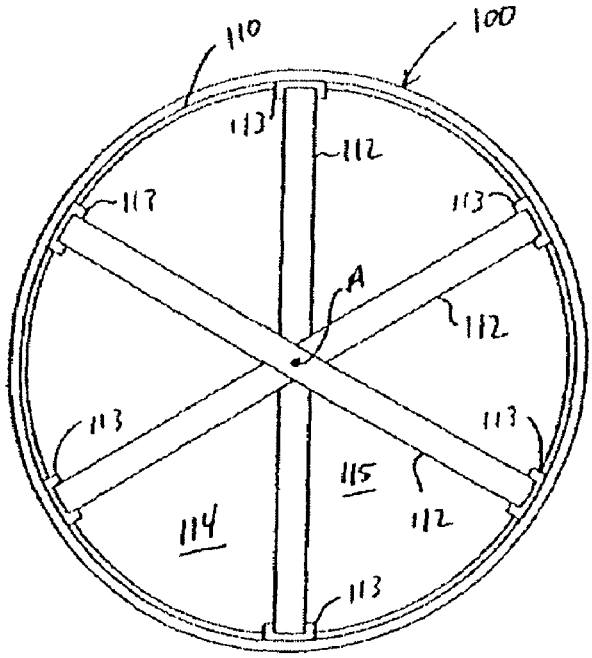
FIG. 3*c* is a partial end view of the third example embodiment shown in FIG. 3*a;*
Figure 4A:
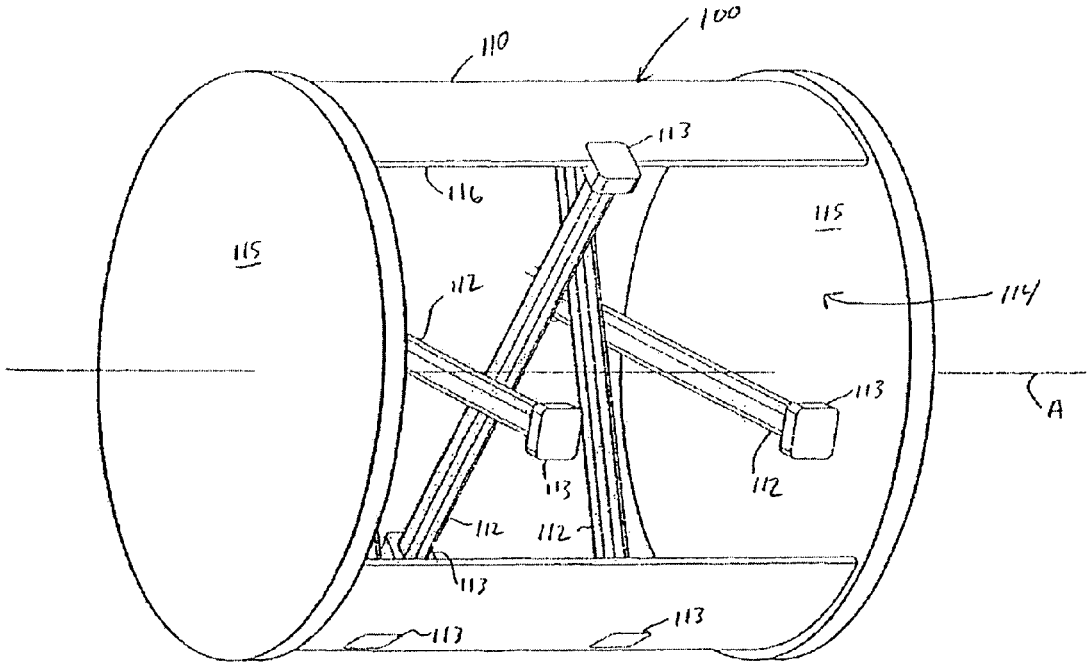
FIG. 4*a* is a partial isometric view showing a fourth example embodiment of the present invention having a portion of the body removed.
Figure 4B:
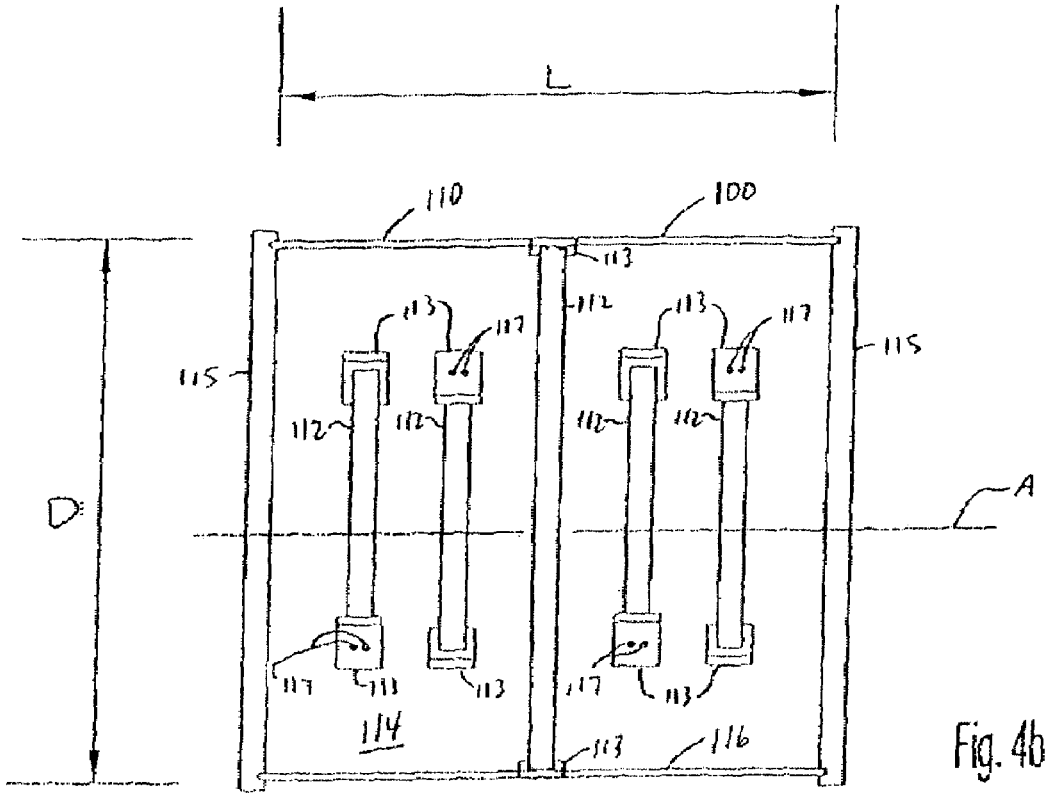
FIG. 4*b* is a partial side view of the fourth example embodiment shown in FIG. 4*a;*
Figure 4C:
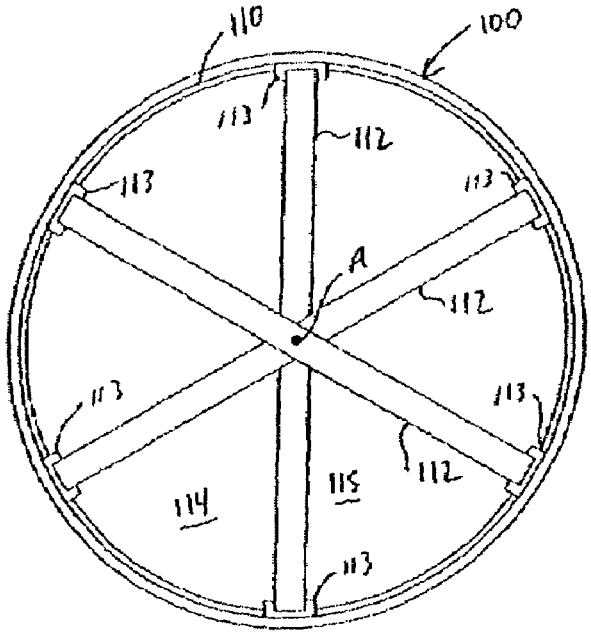
FIG. 4*c* is a partial end view of the fourth example embodiment shown in FIG. 4*a;*

As shown in FIGS. 2*a*-2*c,* 3*a*-3*c,* 4*a*-4*c,* and 5*a*-5*c,* the number, type and distribution of said crosspieces 112 will vary according to reactor 100 dimensions, the loads to which the device 100 will be subject and the type of process intended on each occasion. For example, with reference to FIGS. 2*a*-2*c,* multiple crosspieces 112 extend from the interior surface 116 essentially through the longitudinal axis A, similar to that shown in FIGS. 1*a*-1*c.* Yet another example embodiment of the present invention is shown in FIGS. 3*a*-3*c,* again, the crosspieces 112 extend from the interior surface 116 and are essentially perpendicular to the longitudinal axis A. However, as shown in FIG. 3*c,* the crosspieces 112 intersect the longitudinal axis A at approximately sixty degrees relative to adjacent crosspieces 112. Turning to FIGS. 4*a*-4*c,* an embodiment similar to that shown in FIGS. 3*a*-3*c* is shown with additional crosspieces 112.

Subject to such circumstances, said arrangement may comprise different types of crosspieces 112, studs or rods (FIGS. 6*a*-*h*) cylindrical or rectangular in cross-section, or both at the same time, which may be geometrically homogeneous, may bear baffles 118, paddles 120 or pins 122 across them, according to the use for which the device 100 may be intended.

Figure 5A:
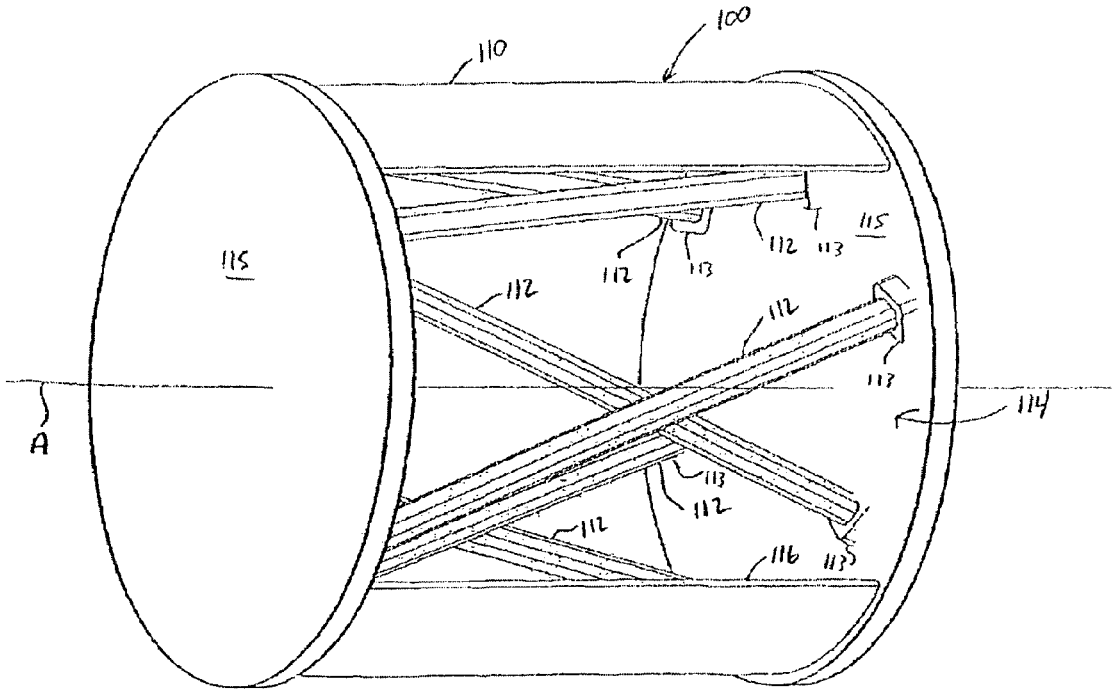
FIG. 5*a* is a partial isometric view showing a fifth example embodiment of the present invention having a portion of the body removed.
Figure 5B:
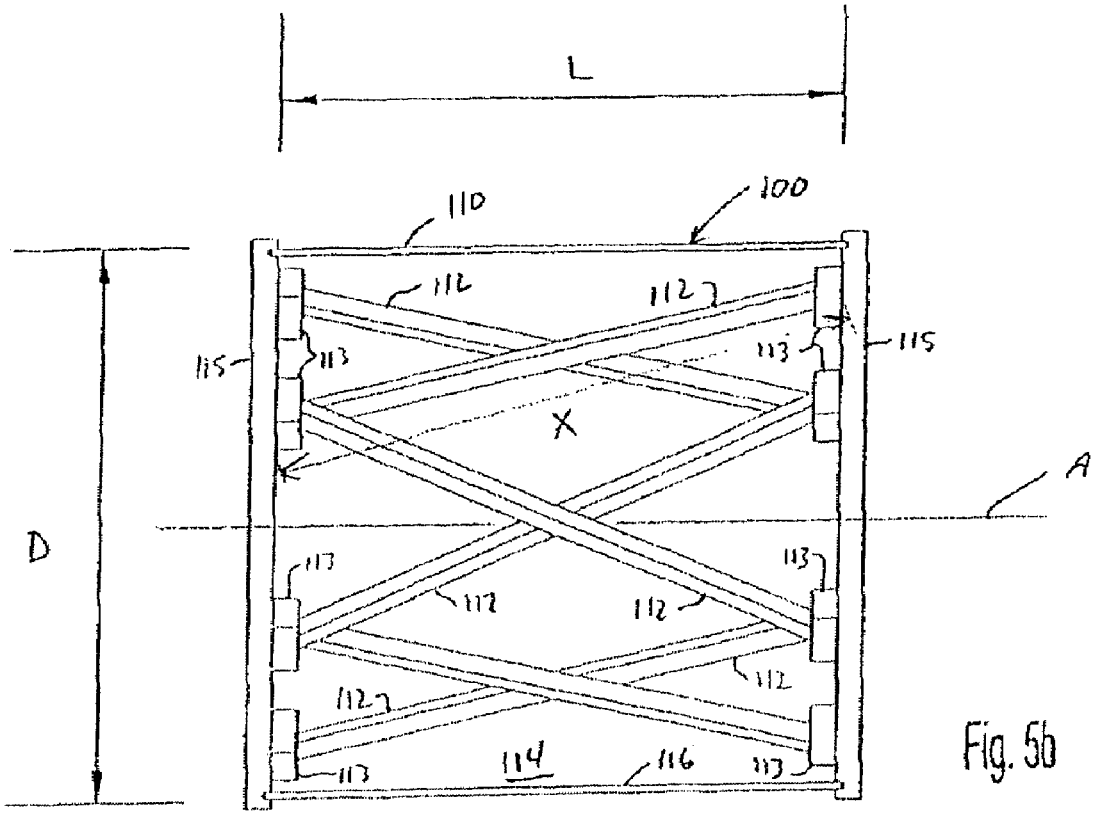
FIG. 5*b* is a partial side view of the fifth example embodiment shown in FIG. 5*a;*
Figure 5C:
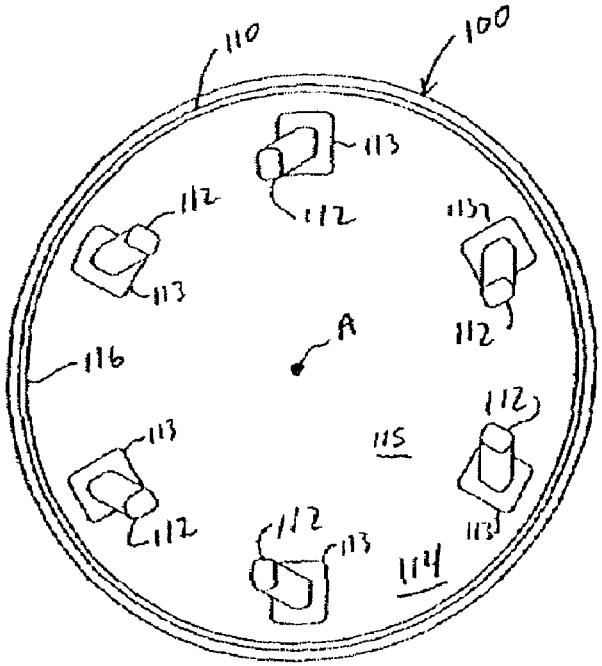
FIG. 5*c* is a partial end view of the fifth example embodiment shown in FIG. 5*a;*
Figure 6E:
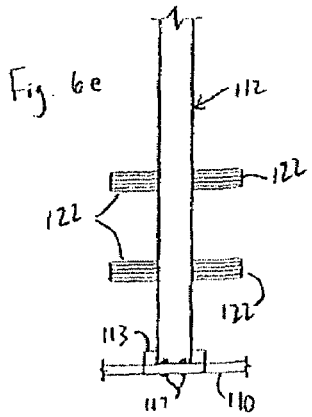
FIG. 6*e* is a partial side view of the example crosspiece shown in FIG. 6*a;*
Figure 6F:
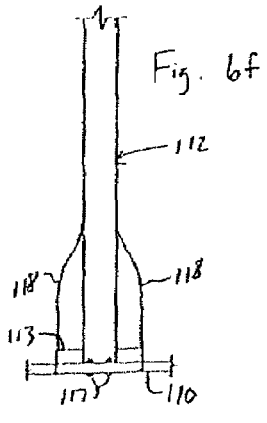
FIG. 6*f* is a partial side view of the example crosspiece shown in FIG. 6*b;*
Figure 6G:
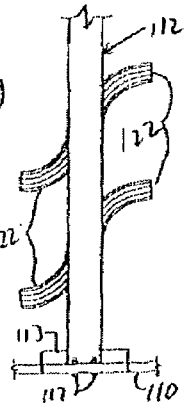
FIG. 6*g* is a partial side view of the example crosspiece shown in FIG. 6*c;*
Figure 6H:
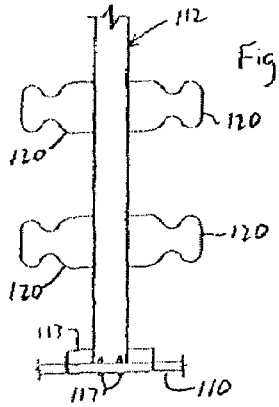
FIG. 6*h* is a partial side view of the example crosspiece shown in FIG. 6*d;*
Figure 6A:
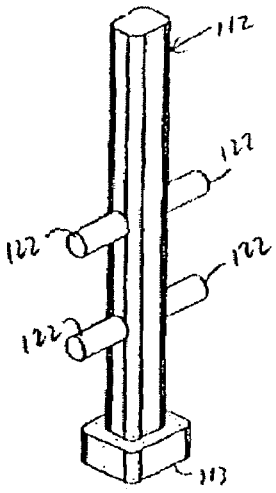
FIG. 6*a* is a perspective view of an example crosspiece in accordance with the present invention.
Figure 6B:
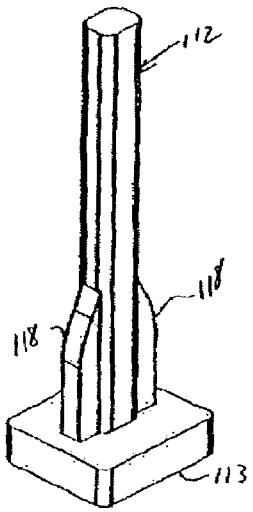
FIG. 6*b* is a perspective view of another example crosspiece in accordance with the present invention.
Figure 6C:
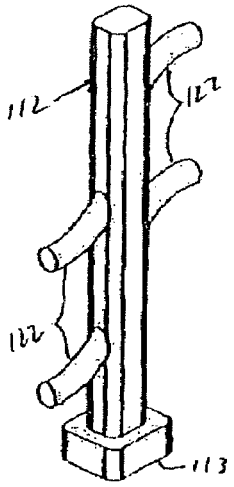
FIG. 6*c* is a perspective view of yet another example crosspiece in accordance with the present invention.
Figure 6D:
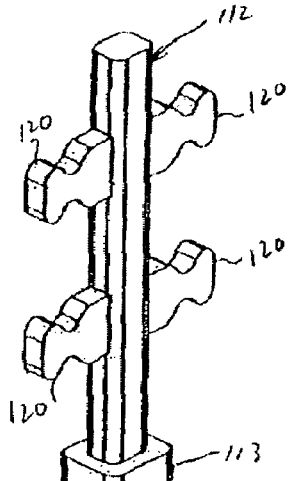
FIG. 6*d* is a perspective view of a further example crosspiece in accordance with the present invention.

Depending on the requirements of use, said crosspieces 112 may be arranged longitudinally (FIGS. 5*a*-*c*) to provide for special treatment processes. With reference to FIGS. 5*a*-5*c,* a reactor 100 is shown with crosspieces 112 that extend essentially between the end walls 115 and do not pass through the longitudinal axis A (shown in FIG. 5*c*). In this embodiment, and as with the previous example embodiments, the length X of the crosspieces 112 may be greater or less than the length L and/or diameter D of the reactor device 100.

Figure 7C:
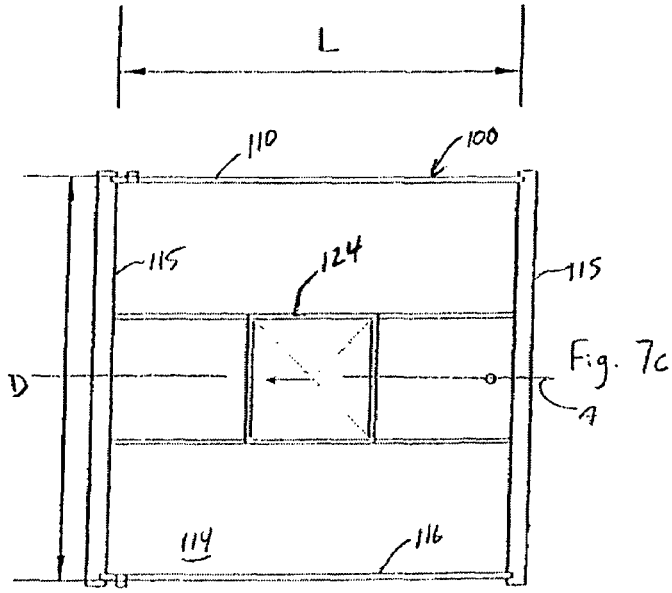
FIG. 7*c* is a partial section view of the body shown in FIG. 7*a.*
Figure 7B:
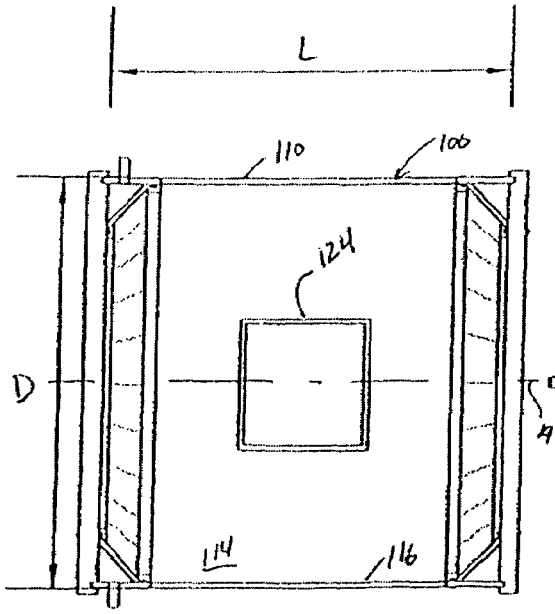
FIG. 7*b* is a side view of the body shown in FIG. 7*a;*.
Figure 7A:
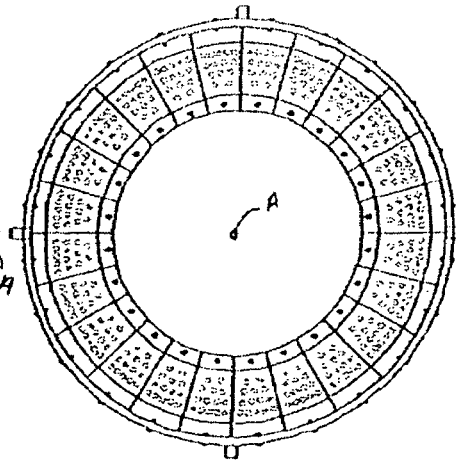
FIG. 7*a* is an end view of a body in accordance with an example embodiment of the present invention.

Finally, as best shown in FIGS. 7*a*-7*c,* the device 100 is provided with gates 124 for loading and unloading its contents, and with lattices and/or valves for the draining of resulting liquids.

The figures illustrate a variety of crosspiece 112 configurations that are within the scope of the present invention. The present invention should not be limited to the embodiments disclosed herein, instead, the claims should be referenced to determine the full scope of the present invention.

The invention claimed is:

1. A spiral system reactor for the treatment of hides and skins, said reactor having a cylindrically shaped body defining a diameter and a longitudinal axis, said body rotating about the longitudinal axis and wherein said body encloses physically nonintersecting crosspieces of diametrical length spaced along at least one axis and intersecting said at least one axis at different angles to provide a plurality of mechanical members for at least one of scraping, tanning, retanning, dressing and beating activities on hides and skins as the body is rotated.

2. The spiral system reactor for the treatment of hides and skins described in claim 1, wherein the physically nonintersecting crosspieces include at least one of baffles, paddles or pins projecting therefrom.

3. The spiral system reactor for the treatment of hides and skins described in claim 1, wherein the axis is a longitudinal axis of rotation for the cylindrically shaped body.

4. The spiral system reactor for the for the treatment of hides and skins described in claim 1, wherein the reactor is provided with gates for loading and unloading hides and skins relative to an interior of the reactor.

5. A spiral system reactor for treatment of hides and skins, comprising:

a cylindrically shaped body rotatable about a longitudinal axis including a pair of end walls connected by an interior surface defining an interior of the body; and a plurality of physically nonintersecting crosspieces within the interior of the body, each physically nonintersecting crosspiece including opposing ends having a base;

wherein the bases of the plurality of physically nonintersecting crosspieces are affixed to at least one of the interior surface and the pair of end walls; and wherein the plurality of physically nonintersecting crosspieces are spaced apart from the interior surface and the pair of end walls.

6. The spiral system reactor for treatment of hides and skins of claim 5, wherein the plurality of physically nonintersecting crosspieces extend through the longitudinal axis.

7. The spiral system reactor for treatment of hides and skins of claim 5, wherein the plurality of physically nonintersecting crosspieces extend essentially perpendicular to the longitudinal axis.

8. The spiral system reactor for treatment of hides and skins of claim 5, wherein the plurality of physically nonintersecting crosspieces include at least one of a baffle, paddle, and pin.

9. The spiral system reactor for treatment of hides and skins of claim 5, wherein the bases are affixed to the interior surface.

10. The spiral system reactor for treatment of hides and skins of claim 5, wherein the bases are affixed to the pair of end walls.

* * * * *